US006499241B1

(12) United States Patent
Vila-Martínez

(10) Patent No.: US 6,499,241 B1
(45) Date of Patent: Dec. 31, 2002

(54) PACKING UNIT SEAL

(75) Inventor: Manuel Vila-Martínez, Barcelona (ES)

(73) Assignee: Aparellaje Electrico, S.L., Barcelona (ES)

( * ) Notice: Subject to any disclaimer, the term of this patent is extended or adjusted under 35 U.S.C. 154(b) by 0 days.

(21) Appl. No.: 09/157,496

(22) Filed: Sep. 21, 1998

(30) Foreign Application Priority Data

Oct. 8, 1997 (ES) ..... 9702563

(51) Int. Cl.[7] ..... G09F 3/00
(52) U.S. Cl. ..... 40/312; 206/807
(58) Field of Search ..... 40/312; 229/125.37; 426/383; 53/415; 206/807; 283/79–81

(56) References Cited

U.S. PATENT DOCUMENTS 1,509,383 A * 9/1924 Walter ..... 229/125.37
2,043,110 A * 6/1936 McLaurin ..... 229/125.37
3,974,959 A * 8/1976 Ruda ..... 206/807
4,128,954 A * 12/1978 White ..... 40/310
5,866,183 A * 2/1999 Small ..... 426/383

FOREIGN PATENT DOCUMENTS

BE 503564 * 9/1952 ..... 229/125.37
DE 33 17 134 A * 11/1984
DE 4028276 * 3/1992 ..... 229/125.37
GB 2 236 100 A * 3/1991

* cited by examiner

*Primary Examiner*—Cassandra H. Davis
(74) *Attorney, Agent, or Firm*—Staas & Halsey LLP

(57) ABSTRACT

The packing unit comprises a parallelepipedic hollow body forming side walls and other side walls opposite to the former; it also comprises a lid attached to one side wall and which is pivotable between an open position and a closed position, in which a slit is formed between the lid and side walls; it further comprises an adhesive sealing tape which, in the closed position, has a first portion adhered to the lid, a second portion which partly conceals the slit and a third portion adhered to the side wall on which a label is fixed.

4 Claims, 1 Drawing Sheet

PACKING UNIT SEAL

FIELD OF THE INVENTION

This invention relates to a packing unit seal, said packing unit: [a] comprising a hollow parallelepipedic shaped body having a bottom wall suitable for forming the base of said packing unit, a first side wall, two second side walls adjacent said first side wall and a fourth side wall opposite said first side wall, all being attached to said bottom wall and to the adjacent side walls; [b] comprising a cover member attached to said fourth side wall and capable of pivoting between an open position and a closed position, in which there is formed a slit between said cover member and said side walls other than said fourth side wall; [c] being suitable for comprising a set number of identical articles; and [d] having an identifying label, located on one of said side walls other than said fourth side wall and suitable for referring to said number and to said articles.

RELATED ART

Said warranty arrangement is particularly applicable to packing units in the form of a box having a lid, generally made from cardboard, for containing a set number of articles of like characteristics, wherein the number and the characteristics are specified on an identifying label together with the brand name and the name of the article. This label is located on one or more of the box surfaces.

In practice, in the warehouses of the manufacturer, of the marketing enterprise, of the distributors, of the retailers and of the users, the said articles, boxed in a set number, are located on shelves and are grouped together so that at least one of their identifying labels remains visible, whereby it is an extremely simple task to locate the article.

Nevertheless, when the time comes to update the stock or take the inventory, the content of each and every one of the stored boxes has to be counted, since there is no certainty that the number of articles contained therein is the same as that appearing on the label, since it is not sufficient simply to inspect the boxes on the shelves to ascertain whether any of them have been opened and one or more of the articles contained therein have been removed.

It would, therefore, be desirable to have an arrangement of the elements of the boxes which allowed the contents thereof to be observed at a glance, without it being necessary to examine the interior thereof.

SUMMARY OF THE INVENTION

It is an object of this invention to overcome the above-mentioned drawback. This object is achieved with a seal of the type first mentioned above, said packing unit seal comprising an adhesive sealing tape which, in the said closed position, has a first portion adhered to said cover member, a second portion partly concealing said slit and a third portion adhered to said side wall on which said label is located, said third portion being in the proximity of said label.

This seal is obviously located on a visible part of the packing unit in the stored position thereof, and it is preferably broken the first time the packing unit is opened without the need of tools.

The invention also contemplates that the sealing tape be made of non-transparent material, may be torn directly by hand without the need for tools and that it be formed by one or more tongues, appendices or extensions of the label itself.

BRIEF DESCRIPTION OF THE DRAWINGS

To facilitate the understanding of the foregoing ideas, there is described hereinafter one embodiment of the invention, with reference to the accompanying illustrative drawings, in which.

DETAILED DESCRIPTION OF THE INVENTION

In the case of a manufacturer of electrical mechanisms, such as switches, plug bases, accessories for electrical installations, etc., the said articles are packed for shipment in cardboard boxes, in each of which a set number of articles is contained. Generally, these packing boxes are parallelepipedic, being preferably right rectangular parallelepipeds, and comprise a hollow body and a lid attached to said body and which is pivotable, in the majority of cases, around the upper edge of one of the lateral sides of the body. Once a set number of articles has been placed in the box, at the works packing section, the usual practice is to ensure the closure of the box with a simple transparent adhesive plastic tape (which may bear indicia) as a warranty seal, which is always located on the longer edge of the lid opposite the edge around which it pivots and requires the use of a tool (knife, scissors, etc.) to break it when opening the box.

In the majority of cases, said boxes or packing units are provided with the identifying labels thereof on one or both of the shorter sides, since this allows them to be placed on the shelves with the major dimension thereof coinciding with the depth of the shelves, allowing maximum advantage to be taken of the shelf space, but it suffers from the drawback that, in such position of the boxes, the closing tape or warranty seal thereof is hidden from sight, whereby it is not possible to detect its integrity at a glance simply by looking at the visible smaller sides of the boxes, where the identifying label is placed, in the normal storage position. This circumstance makes it necessary at least to check box by box whether they have a seal or closing tape, or to count the box content, if they have no seal or the closing tape is unreliable.

Figure 1:
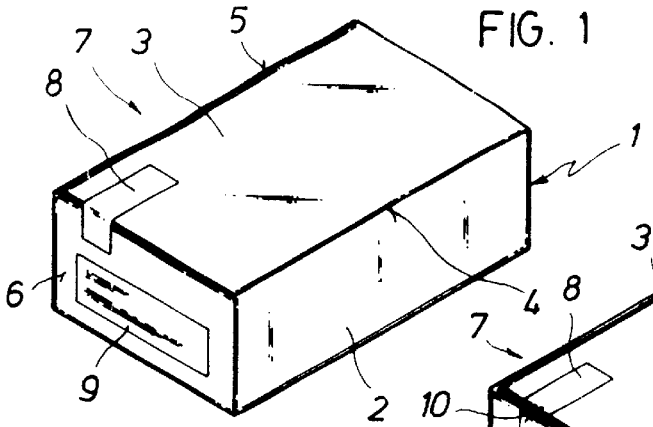
FIG. 1 is a perspective view of a packing unit having the seal of the invention, in the closed position.
Figure 2:
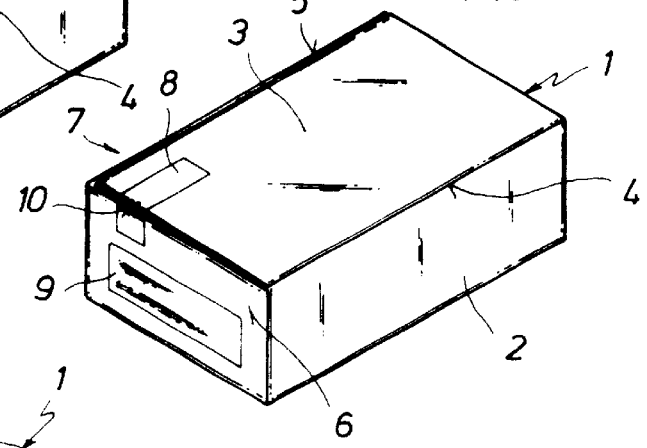
FIG. 2 is a perspective view of the packing unit of the previous Figure in the position resulting from it having been opened.
Figure 3:
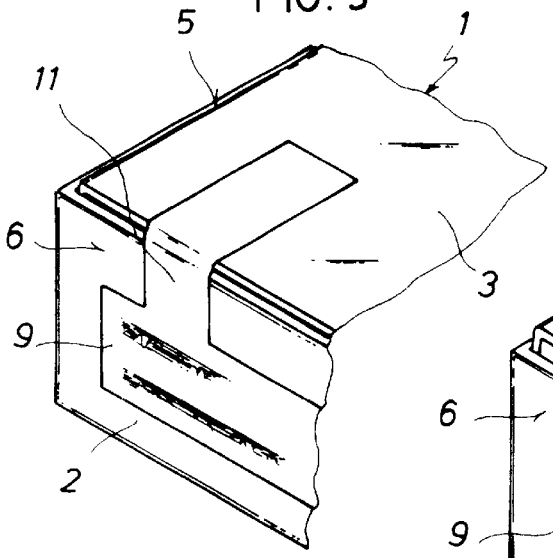
FIG. 3 is a schematic perspective view on a larger scale of a detail of FIG. 1, in which the sealing tape forms an extension of the label.
Figure 4:
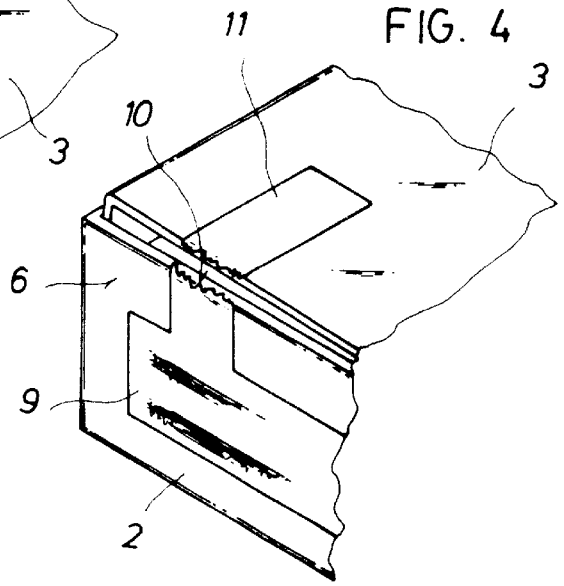
FIG. 4 is a schematic perspective view on a larger scale of a detail of FIG. 2, in which the sealing tape forms an extension of the label.

The invention, as said above, consists of providing the adhesive sealing tape at a point near the label situated on the shorter sides of the box and far away from the axis of pivoting of the lid, as may be seen in FIG. 1 and in the detail of FIG. 3, so that, on opening the box, the breaking of the seal is seen, as may be appreciated in FIG. 2 and in the detail of FIG. 4.

The embodiment shown as an example in the drawings comprises a packing unit 1, preferably in the form of a cardboard box. The packing unit 1 comprises a body 2 and a lid 3 which, as described hereinafter, is attached to the upper edge 4 of one of the side walls of the body 2.

The body 2 has a parallelepipedic form and comprises a rectangular bottom wall, not shown, forming the base of the packing unit. From the edges of this base side there emerge the side walls which are: the second side wall 6 and the opposite one, not shown; the first side wall 7; and the fourth side wall which is opposite this first side wall 7 and which is provided with the upper edge 4. The lid 3 may pivot about this edge 4 between an open position and a closed position, in which there is formed a narrow separating slit between the edges of the side walls 6, 7 and the edges of the free sides of the lid 3.

The invention, applied to this embodiment, consists of arranging an adhesive sealing tape 8, preferably of an opaque or translucent material, at a point on the lid 3 far away from the edge of pivoting 4 and at a point on the body 2 close to the identifying label 9 which is fixed, at least, on one of the second walls 6 of the packing unit.

Figure 5:
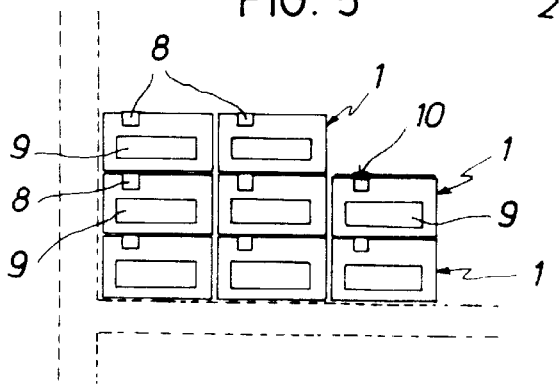
FIG. 5 is a schematic elevation view of a plurality of packing units piled on a shelf and provided with the seal of the invention.

The sealing tape 8 has a first portion adhered to the lid 3, a second portion which partly conceals the slit formed between the body 2 and the lid 3, and a third portion adhered to the side wall on which the label 9 is located. This third portion is in the proximity of the label, as may be observed in FIGS. 1, 3 and 5.

When the box or packing unit 1 is opened, by manually separating the lid 3 from the body 2 by pivoting the former around the hinge line 4, the adhesive sealing tape 8 is broken, there appearing therein a line of separation 10 which is distinguished from the narrow separation slit between the body 2 and the lid 3, which allows the continuity of said slit to be observed all along the longer side of the side wall 6 and it to be deduced that the packing unit 1 has been opened.

This fact allows it to be seen, at a glance, whether a packing unit 1 has been opened or not, from which it may be deduced that one or more of the originally packed articles 20 may be missing from the packing unit 1, requiring them to be counted, or that it is complete, in this case trusting that there have been no packing errors, avoiding the count.

It has been contemplated that the sealing tape forms an extension of the label, such as an appendix 11, tongue or the like, as may be seen in FIGS. 3 and 4.

The constituent material of the sealing tape must be such as to allow it to be broken without using tools.

With this arrangement, it is possible to reduce the stock control and inventory preparation times to the maximum.

What I claim is:

1. A packing unit, comprising:

a container comprising sidewalls and a bottom adjacent the sidewalls, said container holding identical articles;

a cover member hingedly attached to a first one of the sidewalls to pivot between an open position and a closed position, and, when in the closed position, said cover member forms a slit between said cover member and the remaining sidewalls other than the first one of the sidewalls;

an identifying label that is located on a second one of the remaining sidewalls that is not opposite the first sidewall, and identifies both the articles and a number of the articles within said container; and a seal comprising an adhesive sealing tape that, in the closed position, is adhered to said cover member and the second one of the remaining sidewalls so as to both cover a portion of the slit and be in proximity to said identifying label.

2. The packing unit of claim 1, wherein said seal is separate from said identifying label.

3. The packing unit of claim 1, wherein said seal is connected to said identifying label.

4. The packing unit of claim 1, wherein the second one of the sidewalls is disposed such that said identifying label is exposed when stacked with other items.

* * * * *